United States Patent [19]

Koepp, Jr.

[11] Patent Number: 4,864,951

[45] Date of Patent: Sep. 12, 1989

[54] LIGHTWEIGHT CRADLE DAVIT LIFT FOR AN INFLATABLE BOAT

[76] Inventor: O. William Koepp, Jr., 8403 Huron River Dr., Ypsilanti, Mich. 48197

[21] Appl. No.: 182,369

[22] Filed: Apr. 18, 1988

[51] Int. Cl.[4] ..... B63B 23/06

[52] U.S. Cl. ..... 114/44; 114/366; 114/373; 414/678

[58] Field of Search ..... 114/44, 266, 264, 267, 114/343, 354, 362, 268, 364–366, 373; 414/780, 678, 754; 254/127

[56] References Cited

U.S. PATENT DOCUMENTS

| | | | |
|---|---|---|---|
| 759,340 | 5/1904 | Brauchli | 114/366 |
| 2,185,083 | 12/1939 | Horton | 9/22 |
| 2,815,131 | 12/1957 | Lunsman | 114/373 |
| 3,034,156 | 5/1962 | Hollerith | 114/373 |
| 3,114,535 | 12/1963 | Burch | 114/44 |
| 3,143,991 | 8/1964 | Anderson | 114/43.5 |
| 3,191,389 | 6/1965 | Doe | 114/44 |
| 3,216,388 | 11/1965 | Smith | 114/43.5 |
| 3,401,806 | 9/1968 | Schmit | 214/1 |
| 3,647,089 | 3/1972 | Christensen | 214/1 A |
| 3,834,338 | 9/1974 | Rehouf | 114/373 |
| 4,763,593 | 8/1988 | Lasko | 114/44 |
| 4,764,081 | 8/1988 | Peterson | 114/44 |

OTHER PUBLICATIONS

Weaver Snap Davits, Weaver Industries Advertisement ©1987 3 pages.

*Primary Examiner*—Joseph F. Peters, Jr.
*Assistant Examiner*—Clifford T. Bartz
*Attorney, Agent, or Firm*—James M. Deimen

[57] ABSTRACT

A combination cradle and davit lift for small lighweight boats, in particular inflatable boats, comprise a pair of shallow V-shaped tubular cradle members joined by longitudinal members. The longitudinal members are adjustable lengthwise and the cradle members are each adjustable widthwise on either side of the bottom of the V. Detachable hinges are provided for attachment to a swim platform or stern of a large boat. The cradle lift is constructed preferably of suitable hollow rigid plastic tubing for approximately neutral bouyancy whereby the cradles submerge with the outboardmost longitudinal member remaining above the water surface or, in the alternative, the cradle lift is provided with means to prevent sinking of the lift beyond a suitable depth in the water.

20 Claims, 2 Drawing Sheets

LIGHTWEIGHT CRADLE DAVIT LIFT FOR AN INFLATABLE BOAT

BACKGROUND OF THE INVENTION

The field of the invention pertains to devices to lift small boats from the water and, in particular, to davits and cradles on larger boats for lifting and carrying smaller boats.

An early closure, U.S. Pat. No. 759,340, illustrates a boat launching apparatus for large life boats on steamships. The life boat is clamped tightly to a pair of semicircular cradles in turn fastened to a pair of long arms. The long arms in turn are hinged to an upper deck of the steamship.

U.S. Pat. Nos. 2,185,083 and 3,401,806 disclose shallow water and shoreside cradle hoists respectively. Hinged mounts attached to one side of the cradles permit the cradles to be rotated upwardly somewhat more than 90° to raise an enclosed small boat up and out of the water.

U.S. Pat. Nos. 3,143,991 and 3,216,388 disclose a pair of arms that clamp to the gunwale of a small boat and are hinged to the swim platform at the stern of a large boat. The small boat is rotated up and out of the water by a line attached to the opposite gunwale of the small boat. A more complicated hinged frame for lifting a small boat up and out of the water onto a swim deck is disclosed in U.S. Pat. No. 3,647,089. The frame clamps to the small boat gunwale and requires a special line attachment adjacent the opposite gunwale of the small boat.

More recently snap davits that are fastened to the swim deck and adjacent the small boat gunwale have become available. As with some of the above disclosures, special fittings are permanently attached to the gunwales of the small boat. The snap davits, however, provide a more convenient attachment of the small boat to the swim platform. The snap davit device requires special attachments adhesively fastened to the inflated side tube of a rubber inflatable boat. Unfortunately, such attachments are prone to failure in the marine environment.

Despite the disclosures above most inflatable dinghies are carried on the deck of a larger boat, either fully inflated or deflated. Fully inflated a dinghy requires a significant amount of deck space which is at a premium on most boats. Deflated, the dinghy requires inflation for each use which is an inconvenience at best and a time consuming hazard if the dinghy serves as a life boat. Moreover, an unsecured dinghy is difficult to board or to load and unload. It is not unusual for a person to fall into the water in attempting to board and not unknown to lose an outboard motor in attempting to install the motor on the dinghy because of movement of the unsecured dinghy. With a view toward providing a secure means of raising an inflatable dinghy up and out of the water the applicant has developed the following invention.

SUMMARY OF THE INVENTION

The combination cradle and davit lift for small lightweight boats, in particular inflatable boats, comprises a pair of shallow V-shaped tubular cradle members joined by longitudinal members. The longitudinal members are adjustable lengthwise and the cradle members are each adjustable widthwise on either side of the bottom of the V and depthwise adjacent attachment to a boat.

The cradle shallow V-shaped members and longitudial members are preferably formed of a suitable semi-rigid hollow plastic tubing whereby the cradles submerge with the outboardmost longitudinal member remaining above the water surface. Polyvinyl chloride pipe has been found suitable and preferable especially for salt water use. Aluminum or stainless steel tubing can also be used, however, without additional floatation or other means to limit sinking the polyvinyl chloride or metal lifts do not inherently float at the preferred depth for the cradle lift. Limit stops may be provided as attachments or integral with means to attach the cradle lift to a swim platform or stern of a boat. The limit stops prevent the cradle lift from sinking below the preferred depth for loading a dinghy. The cradle lift may also be constructed of a lighter plastic tubing to provide approximately neutral bouyancy for submergence to the preferred depth.

At the preferred depth the small boat or inflatable dinghy either loaded or unloaded will float into position on the cradles. The dinghy may then be secured in the lift with optional straps. With or without the straps the dinghy is prevented from movement away from an adjacent dock or boat during loading or unloading.

The cradle lift is provided with a pair of hinge mountings with detachable pins for attachment to the swim platform or stern of a larger boat. The cradle lift can also be attached to a stationary dock. The adjustable length and width permits the lift to also be disassembled for easy storage and shipment. The detachable pins permit the lift with an inflatable boat secured therein to be detached from the swim platform.

The lift and small boat are rotated and raised by a line from above the stern of a larger boat. No permanent or temporary attachments to the small boat are required.

DESCRIPTION OF THE PREFERRED EMBODIMENT

Figure 1:
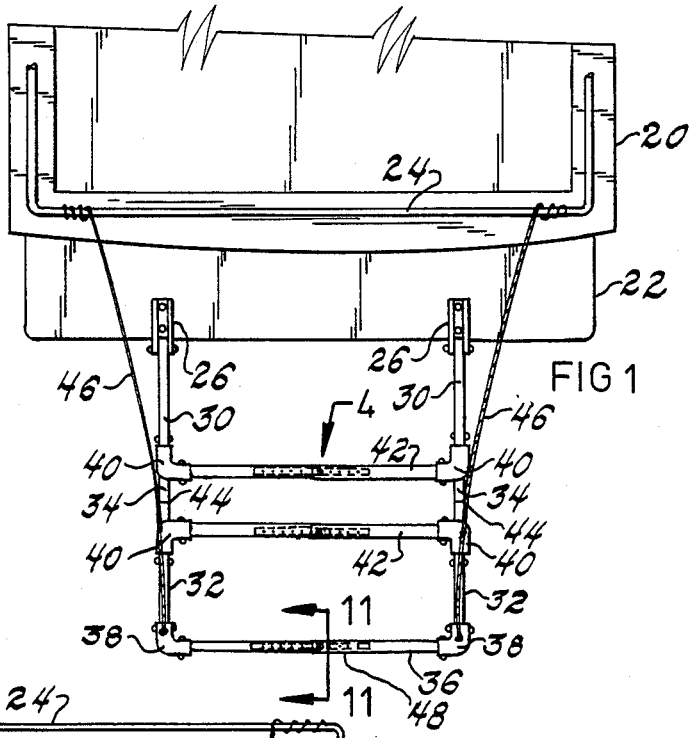
FIG. 1 is a top view of the lift installed on the swim platform of a boat.
Figure 3:
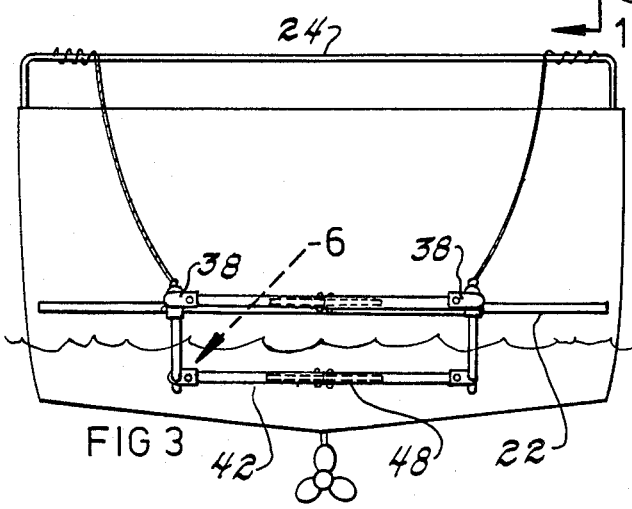
FIG. 3 is a stern view of the lift installed on the swim platform of a boat.
Figure 2:
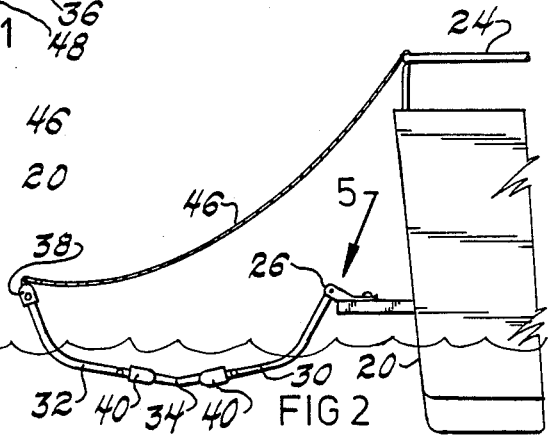
FIG. 2 is a side view of the lift installed on the swim platform of a boat.

Illustrated in FIGS. 1, 2 and 3 is the stern of a power boat 20 having a swim platform 22 and a transom rail 24. Attached to the swim platform 22 are a pair of hinge brackets 26 shown in greater detail in FIG. 5. Attached to each bracket by a clevis pin 28 is an inboard arm 30 having an adjustable inner member 31. Each inboard arm 30 is joined to an outboard arm 32 by an intermediate member 34 to form a pair of cradle members for the lift.

Figure 6:
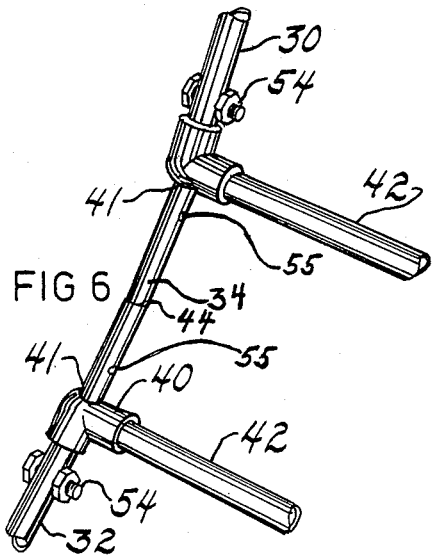
FIG. 6 is a detail of the beam-wise adjustment of the lift.

Joining the outboard ends of the outboard arms 32 is an outboard longitudinal member 36 and 90° elbows 38. At the lower ends of the inboard arms 30 and outboard arms 32 are 90° elbows 40 bored at 41 to accommodate the insertion of the intermediate members 34 into the arms 30 and 32 as best shown in FIG. 6. The 90° elbows 40 are joined longitudinally by longitudinal members 42 spaced to either side of the lowest point 44 of the V-shaped cradle. Attached to the top of each elbow 38 is a line 46 extending to the transom rail 24.

Figure 4:
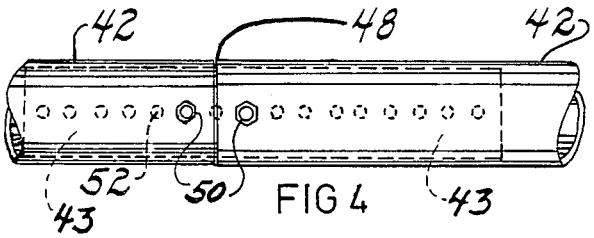
FIG. 4 is a detail of the lengthwise adjustment of the lift.
Figure 11:
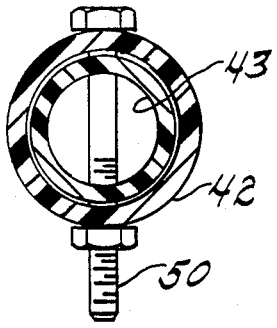
FIG. 11 is a detail of the lengthwise adjustment of the lift taken along the line 11—11 of FIG. 1.
Figure 8:
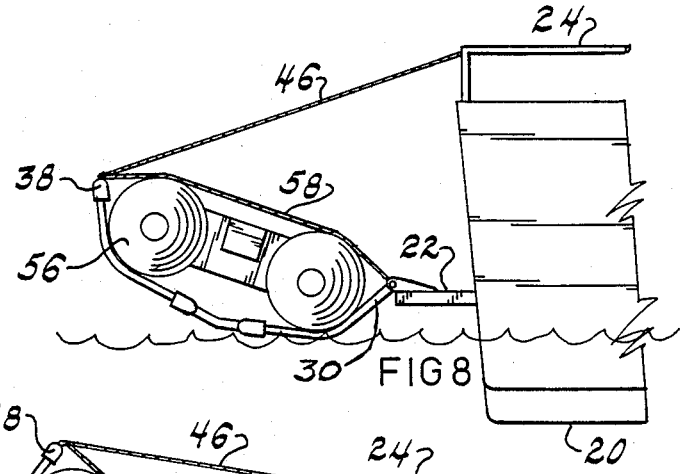

Each of the longitudinal members 36 and 42 is split and telescoped at the center 48 as best shown in FIG. 4 and FIG. 11. The bolts 50 and plurality of holes 52 in the smaller inside member 43 permit the length of the lift to be adjusted and permit the lift to be disassembled into short lengths. In a similar manner the intermediate members 34 telescope into the inboard 30 and outboard 32 arms to provide beam adjustment for the lift and permit the cradle members to be disassembled into short lengths. Bolts 54 and a plurality of holes 55 in the intermediate members 34 provide the adjustment.

Figure 5:
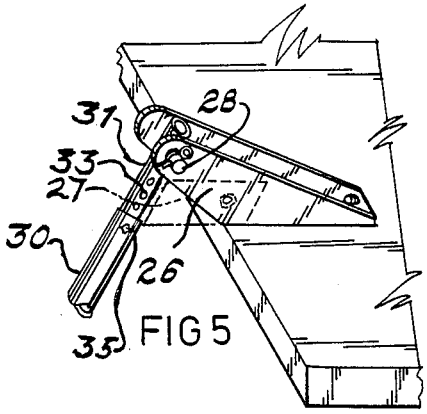
FIG. 5 is a detail of the hinge connection to the swim platform.

As best shown in FIG. 5, each inboard arm 30 includes an adjustable telescoping inner member 31. The inner member 31 includes a plurality of holes 31 for the bolt 35 to provide an adjustment to compensate for the height of the swim platform 22 above the water. The upper end of the inner member 31 engages the clevis pin 28. To provide a limit to the submergence of the cradle, the hinge brackets 26 may include blocks 27 extending from therein for engagement with the inboard arms 30 as shown ghosted.

Once installed to the swim platform 22 further longitudinal adjustment is normally not needed because various lengths of small boat or inflatable dinghy can be accommodated. The beam adjustment can be changed as needed to accommodate a dinghy of different beam.

Figure 7:
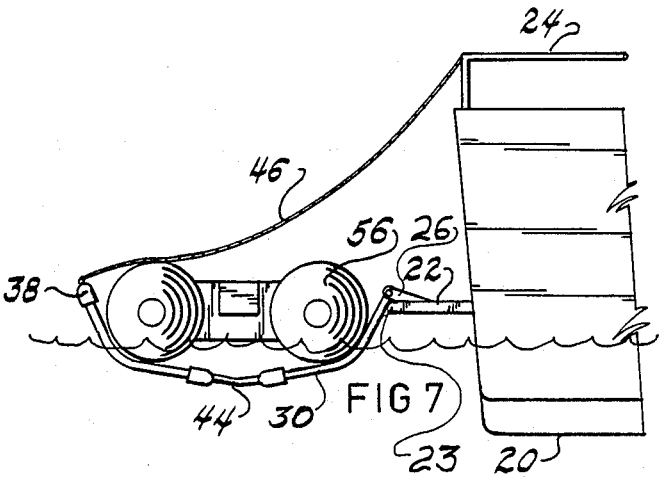
FIGS. 7 through 10 illustrate the operation of the lift.

Illustrated in FIGS. 7 through 10 is the operation of the lift. The lift is partially submerged in FIG. 7 such that an inflatable dinghy 56 can float within the lift with the lines 46 limp as shown in FIG. 7 or FIG. 2. As another option, the hinge brackets 22 may be fastened to the swim platform 22 back from the edge 23 to permit the inboard arms 30 to engage the edge and thereby provide a limit to the submergence of the lift. Pulling on the lines 46 over the transom rail 24 raises and rotates the lift and dinghy 56 up above the swim platform 22 to the position shown in FIG. 10. The lines 46 can then be lashed to the transom rail 22 or otherwise secured on the deck of the power boat 20. The lift and dinghy can be also retained in the position shown in FIG. 9 thereby freeing the swim platform 22 for other use. Optional tie down lines or straps 58, attached to the elbows 38 and inboard arms 30 adjacent the clevis pins 28 to retain the dinghy 56 in place, are preferable to assure the dinghy remains secure.

Figure 12:
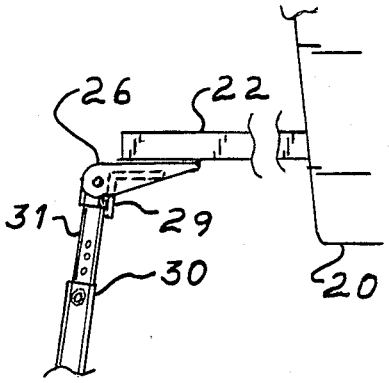
FIG. 12 illustrates an alternate hinge mounting for the lift.
Figure 9:
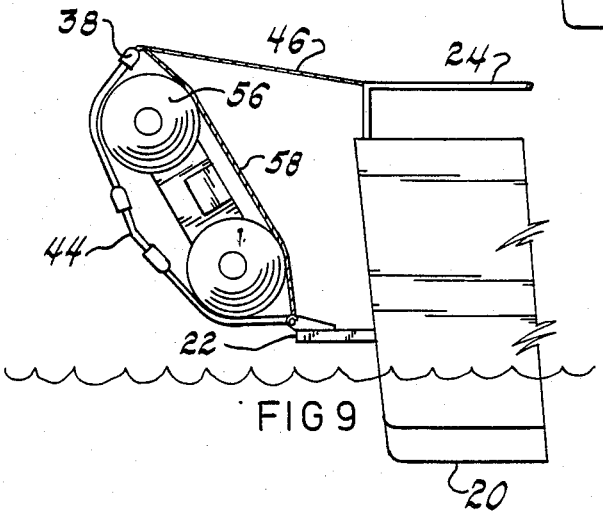
Figure 10:
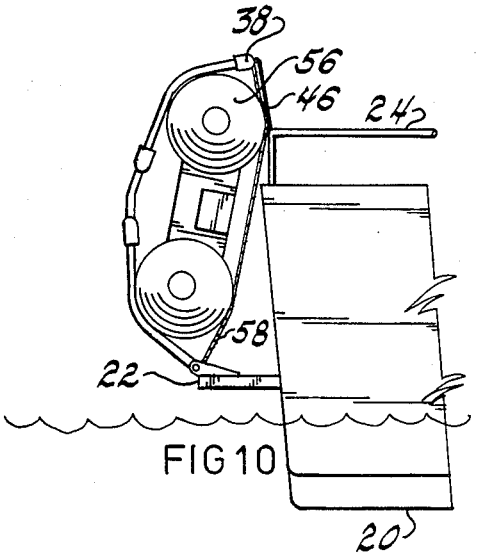

FIG. 12 illustrates an alternative mounting for the cradle lift on a swim platform 22. Rather than being fastened to the top of the swim platform 22, the hinge brackets 26 are fastened underneath thus leaving the deck of the swim platform unobstructed. Fastened within the hinge brackets 26 are L-shaped brackets 29 that extend downwardly to form limit stops for the cradle inboard arms 30 and thereby prevent the cradle lift from sinking below the preferred depth.

A working prototype of the lift was constructed of $1\frac{1}{4}''$ and 1" polyvinyl chloride tubing with a 165° included angle V at 44. The beam adjustment ranges from 51" to 69" and the longitudinal adjustment from 48" to 66". The vertical height from 44 to elbow 38 is 21" and the inboard arms 30 extend with inner member 31 to the clevis pins 28. Unloaded with a swim platform 22 about 8" above the power boat 20 water line, the outboard longitudinal member 36 rests about 4" above the water surface with the lines 46 limp and water filling the tubing. A rubber inflatable dinghy 56, loaded or unloaded, floats easily into or out of the lift. Disassembly permits the entire lift to fit in a 16" by 36" shipping container.

I claim:

1. A lightweight boat lift comprising a pair of generally parallel downwardly V-shaped cradle members, hinge means attached to the inboard ends of the cradle members, an outboard longitudinal member joining the outboard ends of the cradle members, a pair of lower longitudinal members joining the cradle members, said lower members each spaced from the bottom of the cradle V, means to raise the lift about the hinge means, lengthwise adjustment means in said longitudinal members and separate width adjustment means spaced to either side of the bottom of the V in each cradle member.

2. The boat lift of claim 1 wherein the inboard ends of the cradle members are engageable with a swim platform to which the hinge means are attachable.

3. The boat lift of claim 1 wherein the cradle members and longitudinal members are substantially semi-rigid plastic tubing.

4. The boat lift of claim 3 wherein said lift floats with the cradle members substantially submerged and the outboard longitudinal member above the water surface.

5. The boat lift of claim 1 wherein the hinge means is detachable with the lift loaded or unloaded.

6. The boat lift of claim 1 including means to retain a boat in said cradles, said retention means devoid of permanent attachments to said boat.

7. The boat lift of claim 1 wherein the inboard ends of the cradle members include depth adjustment means relative to the hinge means.

8. The boat lift of claim 1 including means adjacent the hinge means to limit rotation of the inboard ends of the cradle members about the hinge means and thereby limit the submergence of the lift.

9. The boat lift of claim 1 wherein the hinge means are adapted for attachment beneath a swim platform.

10. A lightweight boat lift comprising a pair of generally parallel downwardly V-shaped cradle members, hinge means attached to the inboard ends of the cradle members, an outboard longitudinal member joining the outboard ends of the cradle members, a pair of lower longitudinal members joining the cradle members, said lower members each spaced from the bottom of the cradle V, means to raise the lift about the hinge means, said cradle members and lower longitudinal members at least partially formed from materials less dense than water.

11. The boat lift of claim 10 wherein said lift floats with the cradle members substantially submerged and the outboard longitudinal member above the water surface.

12. The boat lift of claim 10 wherein the hinge means is detachable with the lift loaded or unloaded.

13. The boat lift of claim 10 including means to retain a boat in said cradles, said retention means devoid of permanent attachments to said boat.

14. The boat lift of claim 10 wherein the longitudinal members are lengthwise adjustable and the cradle members are beamwise adjustable.

15. The boat lift of claim 10 wherein the inboard ends of the cradle members include depth adjustment means relative to the hinge means.

16. The boat lift of claim 10 wherein the hinge means are adapted for attachment beneath a swim platform.

17. A lightweight boat lift comprising a pair of generally parallel downwardly V-shaped cradle members, hinge means attached to the inboard ends of the cradle members, said hinge means conveniently detachable from the cradle members, an outboard longitudinal member joining the outboard ends of the cradle members and a pair of lower longitudinal members joining the cradle members, said lower longitudinal members each spaced from the bottom of the cradle V and each of the longitudinal members including lengthwise adjustment means, and means to beamwise adjust the cradle members, said beamwise adjustment means spaced to either side of the bottom of each cradle member V.

18. The boat lift of claim 17 wherein the inboard ends of the cradle members include depth adjustment means relative to the hinge means.

19. The boat lift of claim 17 including means adjacent the hinge means to limit rotation of the inboard ends of the cradle members about the hinge means and thereby limit the submergence of the lift.

20. The boat lift of claim 17 wherein the hinge means are adapted for attachment beneath a swim platform.

* * * * *